US011834763B2

(12) United States Patent
Mittal et al.

(10) Patent No.: US 11,834,763 B2
(45) Date of Patent: Dec. 5, 2023

(54) TERRY PRODUCTS COMPRISING PLIED YARNS AND ASSOCIATED METHODS FOR MANUFACTURE

(71) Applicant: Sysco Guest Supply, LLC, Somerset, NJ (US)

(72) Inventors: Khushboo Mittal, Somerset, NJ (US); Mohan Meiyappan Kandhasamy, Somerset, NJ (US)

(73) Assignee: Sysco Guest Supply, LLC, Somerset, NJ (US)

( * ) Notice: Subject to any disclaimer, the term of this patent is extended or adjusted under 35 U.S.C. 154(b) by 0 days.

(21) Appl. No.: 16/226,058

(22) Filed: Dec. 19, 2018

(65) Prior Publication Data

US 2019/0194841 A1 Jun. 27, 2019

Related U.S. Application Data

(60) Provisional application No. 62/608,710, filed on Dec. 21, 2017.

(51) Int. Cl.
*D03D 27/02* (2006.01)
*D03D 27/08* (2006.01)
(Continued)

(52) U.S. Cl.
CPC ..... *D03D 27/08* (2013.01); *A47K 10/02* (2013.01); *D10B 2201/02* (2013.01); *D10B 2331/04* (2013.01)

(58) Field of Classification Search
CPC ..... D03D 27/08; D03D 15/00; D03D 1/0017; D03D 27/00; D03D 27/02; A47K 10/02;
(Continued)

(56) References Cited

U.S. PATENT DOCUMENTS 2,936,569 A * 5/1960 Mull ..... D02G 3/28 57/239
3,101,522 A 8/1963 Hooper et al.
(Continued)

FOREIGN PATENT DOCUMENTS

CN 102071517 A 5/2011
JP 2005052201 A 3/2005

OTHER PUBLICATIONS

"Dyeing in textile industry"; http://wiki.zero-emissions.at/index.php?title=Dyeing_in_textile_industry; Sep. 1, 2016; accessed Jul. 26, 2021. (Year: 2016).*
(Continued)

*Primary Examiner* — Robert H Muromoto, Jr.
(74) *Attorney, Agent, or Firm* — Lowenstein Sandler LLP

(57) ABSTRACT

Terry products include a ground component including a plurality of ground warp yarns and a plurality of weft yarns interwoven with the plurality of ground warp yarns. The ground component includes a lower side and an upper side opposed to the lower side along a vertical direction, and a pile component includes a plurality of piles that extend away from the ground component along the vertical direction. The plurality of piles are formed from a set of pile yarns including plied yarns. The plied yarns include two-ply yarns including natural fiber yarns and polymeric yarns. The natural fiber yarns can include cotton and the like. The polymeric yarns can include polyester and the like.

11 Claims, 5 Drawing Sheets

(51) Int. Cl.
*A47K 10/02* (2006.01)
*D03D 15/40* (2021.01)

(58) Field of Classification Search
CPC ... D10B 2201/02; D10B 2331/04; D02G 3/28
See application file for complete search history.

(56) References Cited

U.S. PATENT DOCUMENTS 3,550,226 A 12/1970 Pachmann
3,721,272 A * 3/1973 Hager ..... D03D 27/08 139/396
3,721,274 A 3/1973 Sherrill et al.
4,368,055 A * 1/1983 Motzkus ..... D06P 3/26 8/606
4,726,400 A 2/1988 Heiman
4,752,299 A * 6/1988 Annen ..... D06P 3/8252 8/674
4,801,303 A * 1/1989 Carlough ..... D06P 1/30 8/642
5,525,124 A * 6/1996 Landre ..... D06P 3/663 8/549
6,030,419 A * 2/2000 Strahm ..... D06P 3/54 8/582
6,062,272 A * 5/2000 Waite ..... D03D 15/00 139/420 A
6,113,656 A * 9/2000 Kimbrell ..... D06M 13/332 8/930
6,546,965 B2 4/2003 Hamby et al.
7,011,116 B2 * 3/2006 Krumm ..... D03D 39/226 139/190
7,044,173 B2 5/2006 Silver
7,111,648 B2 9/2006 Mitchell et al.
7,673,656 B2 * 3/2010 Heiman ..... D03D 27/08 139/391
8,578,972 B2 11/2013 Duan
8,733,075 B2 * 5/2014 Mandawewala ..... A47K 10/02 57/5
9,677,201 B2 * 6/2017 Mandawewala ..... D03D 15/06
10,072,364 B2 * 9/2018 Goenka ..... D03D 15/0027
2009/0025818 A1 * 1/2009 Hozumi ..... D03D 15/00 139/392
2014/0317865 A1 * 10/2014 Krishna ..... D06M 16/003 15/209.1
2015/0167210 A1 6/2015 Tomlin
2017/0088986 A1 3/2017 Gupta
2018/0266022 A1 * 9/2018 Mandawewala ..... D02G 3/44

OTHER PUBLICATIONS

"Terry Weaving" available at the website: https://textInfo.files.wordpress.com/2011/10/terry-towel.pdf; pp. 1-31.
Patil, Rushar C.; "Terry Towels—Classification, Designing & Manufacturing Technology" International Journal on Textile Engineering and Processes, ISSN: 23953578, vol. 1, Issue 1, Jan. 2015; pp. 23-31.

* cited by examiner

TERRY PRODUCTS COMPRISING PLIED YARNS AND ASSOCIATED METHODS FOR MANUFACTURE

CROSS-REFERENCE TO RELATED APPLICATIONS

This patent application is a non-provisional of and claims priority to and the benefit of U.S. Provisional Patent Application No. 62/608,710, filed on Dec. 21, 2017, which is incorporated herein by reference in its entirety.

TECHNICAL FIELD

Embodiments described herein generally relate to terry products and associated methods for manufacture. More specifically, example embodiments relate to terry products such as terry towels used in institutional, industrial, and hospitality industries.

BACKGROUND

Conventional towels for use against the skin are formed from terry fabrics comprised of ground warp yarns, ground weft yarns, and pile yarns woven into a single terry fabric. Selection of yarn for such toweling products often involves a compromise between hand or "feel" and durability. For example, where the yarns are all-natural, 100% cotton, the resultant towel has a hand that is desirably comfortable and pleasing to the user. However, 100% cotton towels do not wear well nor do they readily survive the sometimes harsh laundering procedures to which they may be exposed, especially in commercial or industrial applications such as encountered in connection with hospitals, rest homes, clinics, hotels, and the like. In this regard, such towels must be able to withstand several hundred institutional laundry cycles of high temperature or caustic washing, drying, and possibly even steam sterilization.

It is well known to manufacture towels in a process utilizing yarn spun from 100% cotton fibers. In manufacturing such a towel, the yarn is woven, as is well known, on a loom with the 100% cotton yarn being contained in the ground warp, weft, and pile yarns. In fact it is the 100% cotton aspect of the towel that makes it more "desirable" by the consumer since it is fixed in the mind of the purchaser that 100% cotton towels are more absorbent than other types of towels. However, when considering an institutional towel there are many drawbacks to providing 100% cotton spun yarns woven into towels since there are other issues which must be considered, which from an institutional standpoint creates disadvantages to the institution, for example a hotel chain. A hotel providing towels is a cost of doing business, thus any reductions in the cost of providing towels goes straight to the bottom line. However, in hospitality, cost reductions are generally not acceptable if customer satisfaction is sacrificed.

SUMMARY

Accordingly, one example embodiment is a terry product, such as terry towel, including a ground component including a plurality of ground warp yarns and a plurality of weft yarns interwoven with the plurality of ground warp yarns, the ground component including a lower side and an upper side opposed to the lower side along a vertical direction, and a pile component including a plurality of piles that extend away from the ground component along the vertical direction. The plurality of piles are formed from a set of pile yarns comprising plied yarns. The plied yarns may include at least one of two-ply yarns, three-ply yarns, four-ply yarns, five-ply yarns, and six-ply yarns. For example, the plied yarns include two-ply yarns including a natural fiber yarn and a polymeric yarn. The natural fiber yarn may include cotton yarn that is white or undyed. The polymeric yarn may include polyester yarn. The polyester yarn can be disperse dyed polyester yarn. The polyester yarn may include at least one of spun yarn and continuous filament yarn. The polyester yarn may be a dope-dyed yarn, a fiber-dyed yarn, or a yarn-dyed yarn. The ground warp yarns comprise 100% cotton yarns, 100% polyester yarns, or blended yarns comprising cotton and polyester. Similarly, the ground weft yarns comprise 100% cotton yarns, 100% polyester yarns, or blended yarns comprising cotton and polyester. The polyester may be disperse dyed or undyed. Alternatively, the polyester yarn may be undyed polyester yarn, and the terry product may be disperse dyed or bleached. The weight of the terry product can be about 300-1000 gram per square meter (GSM). The pile yarns may be looped or sheared. The polymeric yarn may have a count in a range between about 30 denier to about 885 denier. The natural fiber yarn may have a count in a range between about 5 Ne to about 100 Ne.

In some embodiments, the plied yarns may also be included in the ground warp and/or ground weft yarns. For example, the plied yarns may be woven in the pile, ground warp, and ground weft directions. In some embodiments, the plied yarns may only be included in the ground warp and pile directions. In some embodiments, the plied yarns may only be included in the ground weft and pile directions. Alternatively, in some embodiments, the plied yarns may only be included in the ground warp and ground weft directions.

Another example embodiment is a method of making a terry product including disperse dyeing polyester yarn, plying the dyed polyester yarn with cotton yarn, and weaving a plurality of ground warp yarns with a plurality of ground weft yarns, and weaving the plied yarns in a pile direction to form a plurality of piles.

Another example embodiment is a method of making a terry product including plying polyester yarn with cotton yarn to form a two-ply yarn, weaving a plurality of ground warp yarns with a plurality of ground weft yarns, weaving the plied yarns in a pile direction to form a plurality of piles, and disperse dyeing the terry product. Accordingly, the polyester component in the plied yarns in all of the above example embodiments can be dyed either in yarn form before being woven into the terry product, or after being woven into the terry product.

BRIEF DESCRIPTION OF THE DRAWINGS

All aspects and features of certain example embodiments of the present disclosure will be more apparent from the following description taken in conjunction with the accompanying drawings, in which.

The following description and the drawings sufficiently illustrate specific embodiments to enable those skilled in the art to practice them. Other embodiments may incorporate structural, process, and other changes. Portions and features of some embodiments may be included in, or substituted for, those of other embodiments. Details of one or more implementations are set forth in the accompanying drawings and in the description below. Further embodiments, features, and aspects will become apparent from the description, the drawings, and the claims. Embodiments set forth in the claims encompass all available equivalents of those claims.

DETAILED DESCRIPTION

Figure 1:
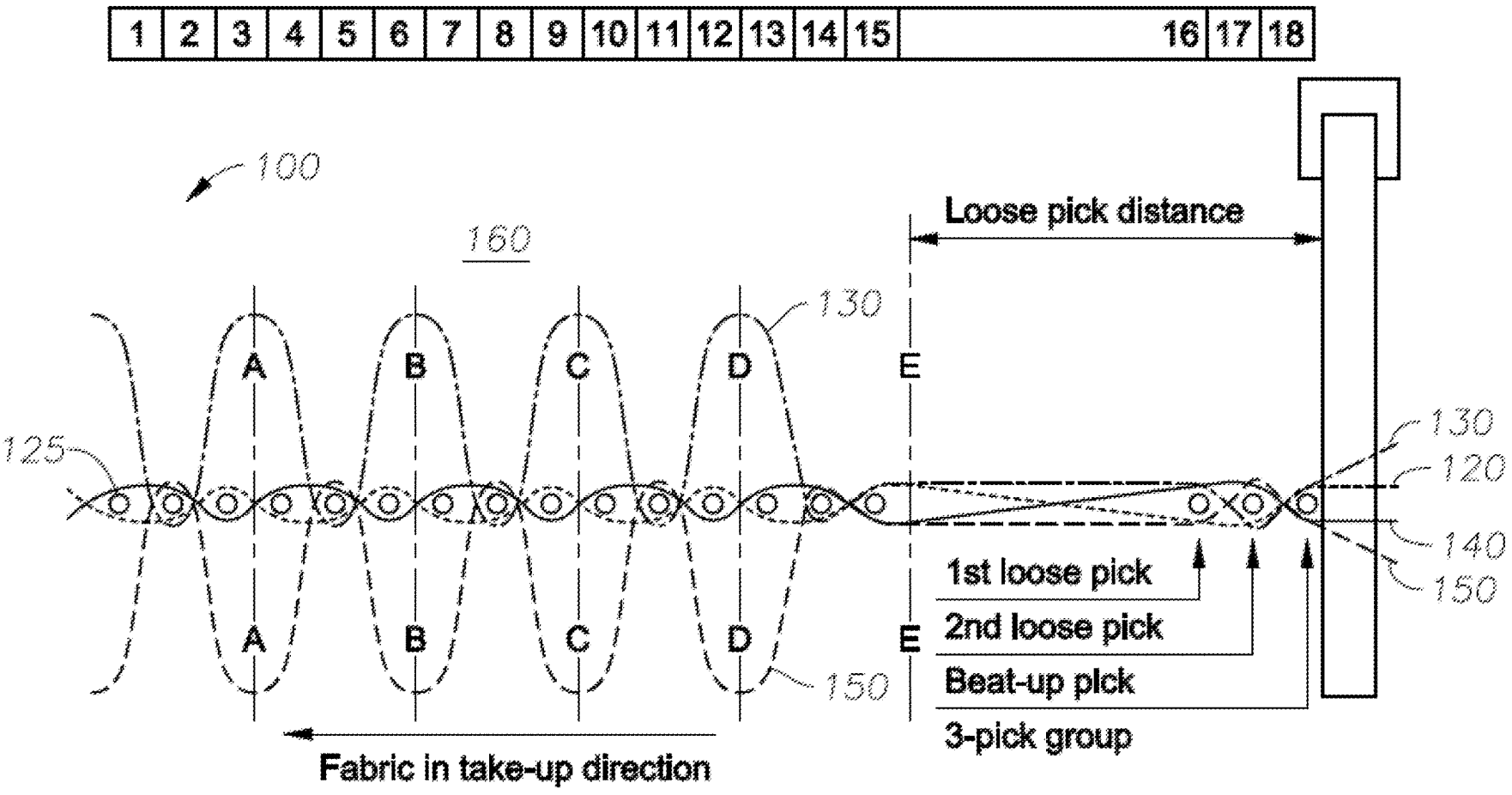
FIG. 1 is an illustrative view of a terry towel or product in accordance with one or more example embodiments.

Turning now to the figures, FIG. 1 illustrates a terry product 100 according to one or more example embodiments of the present disclosure. The terry product may be a terry towel, bath robe, rug, top of the bed fabric, bath mat, or a seat cover. Terry product 100 may include one or more layers of ground warp yarns 120, 140, one or more layers of pile warp yarns 130, 150, and one or more layers of ground weft yarns 125, which may be interwoven with the one or more layers of ground warp yarns 120, 140 and the one or more layers of pile warp yarns 130, 150, as shown in FIG. 1. Terry towel 100 may be a single layer fabric or a multi-layer fabric including more than one layer of warp and weft yarns. Other design features that may impact product properties and therefore contribute to performance of the product during use include fiber type, yarn type, yarn count, pile height, pile density, ground fabric structure, and fabric weight.

Accordingly, one example embodiment is a terry product 100, such as terry towel, including a ground component including a plurality of ground warp yarns 120, 140 and a plurality of weft yarns 125 interwoven with the plurality of ground warp yarns 120, 140. The ground component may include a lower side 170 and an upper side 160 opposed to the lower side along a vertical direction, and a pile component including a plurality of piles 130, 150 that extend away from the ground component along the vertical direction. The plurality of piles 130, 150 may be formed from a set of pile yarns including plied yarns 200 (shown in FIGS. 2A and 2B). The ground warp yarns may include 100% cotton yarns, 100% polyester yarns, or blended yarns including cotton and polyester. Similarly, the ground weft yarns may include 100% cotton yarns, 100% polyester yarns, or blended yarns including cotton and polyester. The polyester in the ground component may be disperse dyed or undyed polyester yarn.

In some embodiments, the plied yarns may also be included in the ground warp and/or ground weft yarns. For example, the plied yarns may be woven in the pile, ground warp, and ground weft directions. In some embodiments, the plied yarns may only be included in the ground warp and pile directions. In some embodiments, the plied yarns may only be included in the ground weft and pile directions. Alternatively, in some embodiments, the plied yarns may only be included in the ground warp and ground weft directions.

Figure 2A:
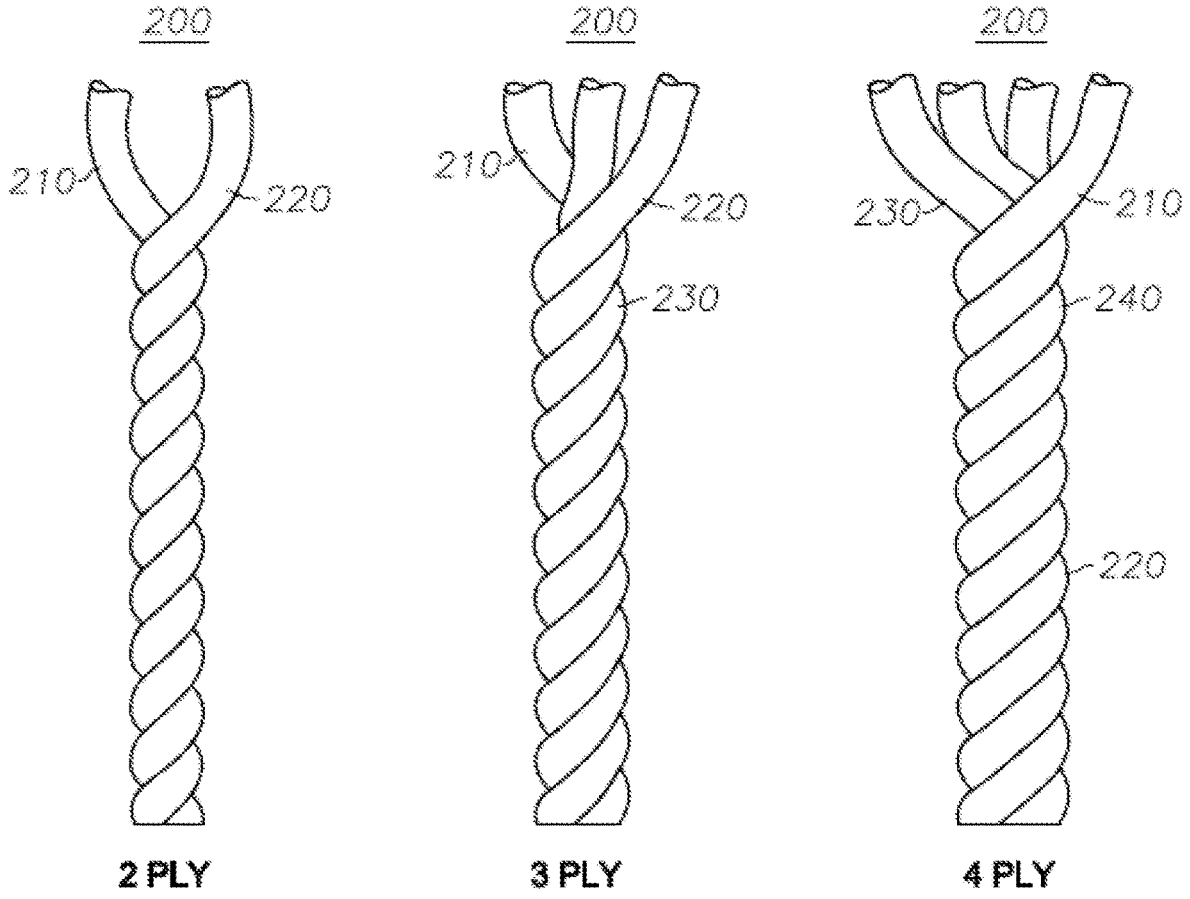
FIGS. 2A and 2B illustrate example steps involved in producing a plied yarn, according to one or more example embodiments.
Figure 2B:
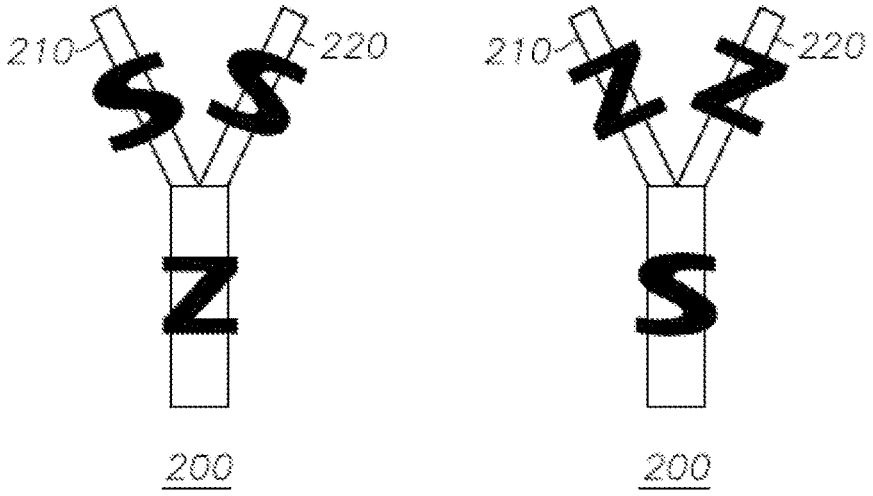

FIGS. 2A and 2B illustrate example steps involved in producing a plied yarn 200, according to one or more example embodiments. As illustrated in FIG. 2A, the plied yarns may include at least one of two-ply yarns, three-ply yarns, four-ply yarns, five-ply yarns and six-ply yarns. For example, the plied yarns may include two-ply yarns including a natural fiber yarn 210 and a polymeric yarn 220. The natural fiber yarn 210 may include cotton yarn that is white or undyed. The polymeric yarn 220 may include polyester yarn. The polyester yarn 220 can be disperse dyed polyester yarn, and may include at least one of spun yarn and continuous filament yarn. The polyester yarn 220 may be a dope-dyed yarn, or a fiber-dyed yarn, or a yarn-dyed yarn. The polymeric yarn 220 may have a count in a range between about 30 denier to about 885 denier. The natural fiber yarn 210 may have a count in a range between about 5 Ne to about 100 Ne. In some embodiments, the plied yarn may include a three-ply yarn including a third component 230, which may be cotton or polyester. In some embodiments, the plied yarn may include a four-ply yarn including a fourth component 240, which may again be cotton or polyester.

Plying is a process used to create a strong, balanced yarn. It is done by taking two or more strands of yarn that each have a twist to them and twisting them together. The strands are twisted together, in the direction opposite that in which they were spun. When just the right amount of twist is added, this creates a balanced yarn, one which has no tendency to twist upon itself. A two-ply is thus a yarn plied from two strands, a six-ply is one from six strands, and so on. The creation of two-ply yarn requires two separate spools of singles and either a lazy kate or something to hold the spools in place. On a wheel, two-ply is created by taking two spools of singles, placing them on a lazy kate, tying the ends together onto the spool attached to the wheel, and spinning the wheel in the opposite direction to that in which the singles were spun, while also feeding the yarn onto the spool on the wheel. On a drop spindle, two-ply is created by placing the spools on a lazy kate, tying the ends together onto the drop spindle, holding equal lengths of singles together and dropping the spindle. The weight of the drop spindle combined with the twist in the singles, causes the drop spindle to turn in the opposite direction that the singles were twisted in until the two singles are plied together.

As illustrated in FIG. 2B, the natural fiber yarn 210 and the polymeric yarn 220 can have a S twist and the plied yarn 200 may be formed by twisting them in the Z direction. Alternatively, the natural fiber yarn 210 and the polymeric yarn 220 can have a Z twist and the plied yarn 200 may be formed by twisting them in the S direction.

Figure 3:
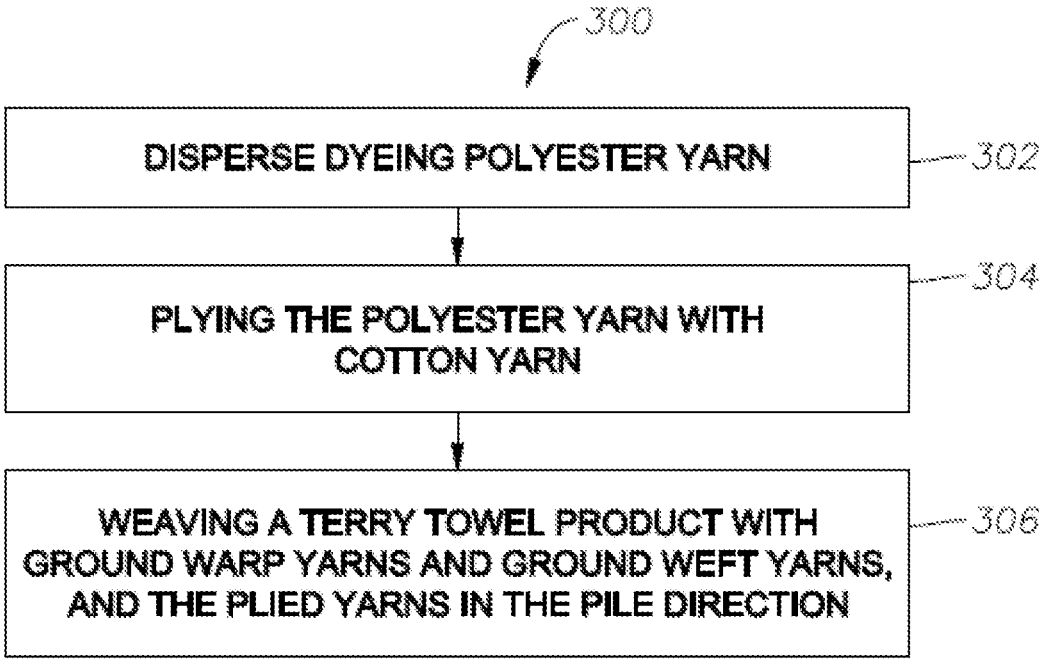
FIG. 3 illustrates example steps in a method for manufacturing a terry product in accordance with one or more example embodiments.

FIG. 3 illustrates example steps in a method 300 for manufacturing a terry product in accordance with one or more example embodiments. The method may include disperse dyeing polyester yarn, at step 302. The method may next include plying the dyed polyester yarn with cotton yarn to produce a plied yarn, at step 304. The method may further include weaving a plurality of ground warp yarns with a plurality of ground weft yarns, and weaving the plied yarns in a pile direction to form a plurality of piles, at step 306.

Disperse dyes are the only water-insoluble dyes that dye polyester and acetate fibers. Disperse dye molecules are the smallest dye molecules among all dyes. A disperse dye molecule is based on an azobenzene or anthraquinone molecule with nitro, amine, or hydroxyl groups, for example, attached to it. Disperse dyes are synthetic dyes. Disperse dye is one kind of organic substances which is free of ionizing group. Disperse dyes are less soluble in water and used for dyeing synthetic textile materials. Disperse dyes is mainly used for dyeing polyester yarn or terry fabric. On the other hand, reactive dyes are used for coloring cotton or cellulosic fiber. Disperse dye is so called because it is non soluble and molecularly dispersed therefore dispersing agent is necessary for coloration with disperse dyes.

The disperse dye may be one kind of organic substances which is free of ionizing group. Disperse dye may be non-soluble in nature, and may be insoluble in water. A dispersing agent may be needed for dyeing with disperse dyes. Fastness properties specially wet and light fastness may be good to excellent with use of the disperse dye. Disperse dyes dyeing is carried out at high temperatures. In some case carrier method is applied for dyeing of polyester with disperse dyes. Disperse dyes are economical. Molecular size of disperse dyes are smaller than other dyes. Disperse dyes are derivatives of azo, anthroquinone, nitro and quinine groups. Disperse dyes dyeing is carried out in high temperature for this reason dyeing machine should have the capability of serving this process.

Figure 4:
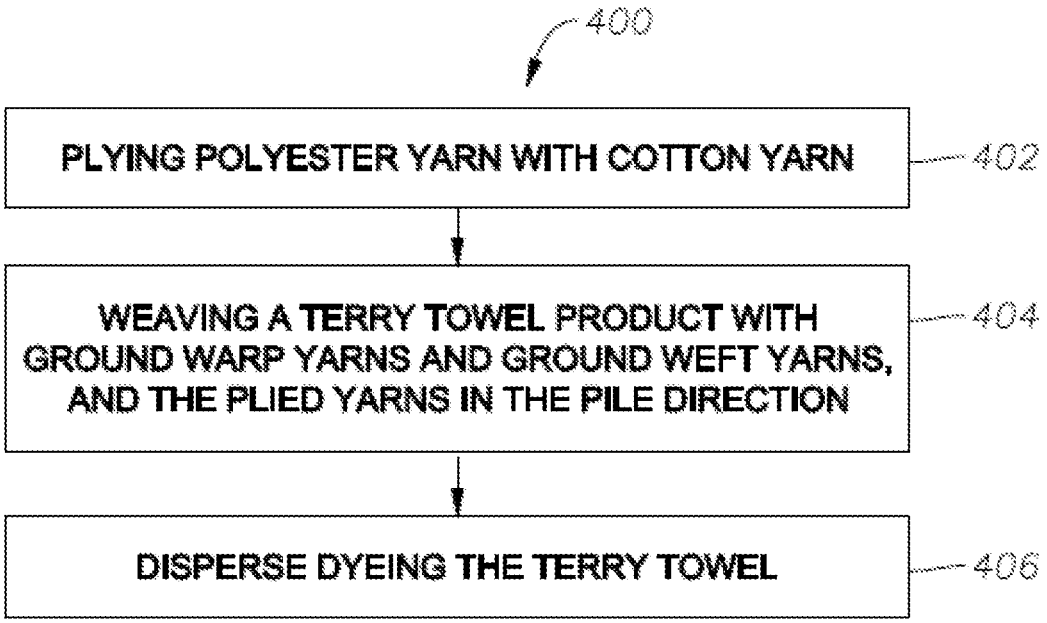
FIG. 4 illustrates example steps in a method for manufacturing a terry product in accordance with one or more example embodiments.

FIG. 4 illustrates example steps in a method 400 for manufacturing a terry product in accordance with one or more example embodiments. The method may include plying polyester yarn with cotton yarn to form a two-ply yarn, at step 402. At step 404, the method may include weaving a plurality of ground warp yarns with a plurality of ground weft yarns, and weaving the plied yarns in a pile direction to form a plurality of piles with the plied yarns. At step 406, method may include disperse dyeing the terry product such that only the polyester fiber absorbs the disperse dye, and natural fiber portion of the product is undyed.

Accordingly, the polyester component in the plied yarns in all of the above example embodiments can be dyed either in yarn form before being woven into the terry product, or after being woven into the terry product.

Disperse dyes are the only water-insoluble dyes that dye polyester and acetate fibers. Disperse dye molecules are the smallest dye molecules among all dyes. A disperse dye molecule is based on an azobenzene (as Disperse Red 1 or Disperse Orange 37) or anthraquinone molecule with nitro, amine, and hydroxyl groups attached to it. Disperse dyes have substantivity for one or more hydrophobic fibers e.g. cellulose acetate, nylon, polyester, acrylic and other synthetic fibers. The negative charge on the surface of hydrophobic fibers like polyester can not be reduced by any means, so non-ionic dyes like disperse dyes are used which are not influenced by that surface charge. Disperse dyes are nonionic dyes. So they are free from ionizing group. They are ready made dyes and are insoluble in water or have very low water solubility. They are organic coloring substances which are suitable for dyeing hydrophobic fibers. Carrier or dispersing agents may be required for dyeing with disperse dyes. Disperse dyes have very good wash fastness with a rating about 4-5. In some embodiments, the disperse dye may include at least one of nitro dyes, amino ketone dyes, anthraquinonoid dyes, mono azo dyes, and diazo dyes.

The following methods of dyeing may be used to dye polyester yarn prior to being woven into the towel or after being woven into the towel. In some embodiments, highly exhaust (H-E) reactive dyes may be used. H-E reactive dyes are stable at higher temperature like 130° C. and are applied in one bath-one step and one bath-two step methods in dyeing polyester-cotton or polyester-viscose blends. The first method is used in producing light shades and the second one to produce heavier shades, mainly where reduction clearing is essential after disperse dyeing.

In the first method, i.e., one bath-one step method, H-E reactive dyes are mixed with disperse dyes. After dyeing of polyester part with disperse dye as usual at 130° C., bath is cooled down to 95° C., salt is added followed by alkali at 85° C. Dye, salt and alkali—all should be increased by 10-15% while dyeing in jigger, because of the higher liquor ratio used in jet dyeing machines. A part of alkali neutralizes acetic acid used in dyeing of polyester.

In the second method, i.e., one bath-two step method, rather than using H-E reactive dyes along with disperse dyes, polyester part is dyed, followed by reduction clearing, washing and mild acid treatment to the terry fabric, which is then dyed with H-E reactive dyes.

The yarn or terry fabric may be dyed using normal dyeing method using normal dyeing temperatures between 80 and 100 degrees C., normal dyeing temperatures with carriers, or high temperature dyeing method. The dyeing of hydrophobic fibers like polyester fibers with disperse dyes may be considered as a process of dye transfer from liquid solvent (water) to a solid organic solvent (fiber). Disperse dyes are added to water with a surface active agent to form an aqueous dispersion. The insolubility of disperse dyes enables them to leave the dye liquor as they are more substantive to the organic fiber than to the inorganic dye liquor. The application of heat to the dye liquor increases the energy of dye molecules and accelerates the dyeing of textile fibers.

Heating of dye liquor swells the fiber to some extent and assists the dye to penetrate the fiber polymer system. Thus the dye molecule takes its place in the amorphous regions of the fiber. Once taking place within the fiber polymer system, the dye molecules are held by hydrogen bonds and Van Der Waals' force.

The dyeing is considered to take place in the following simultaneous steps: Diffusion of dye in solid phase into water by breaking up into individual molecules. This diffusion depends on dispersibility and solubility of dyestuff and is aided by the presence of dispersing agents and increasing temperature. Adsorption of the dissolved dye from the solution onto the fiber surface. This dyestuff adsorption by fiber surface is influenced by the solubility of the dye in the dye bath and that in the fiber. Diffusion of the adsorbed dye from the fiber surface into the interior of the fiber substance towards the centre. In normal condition, the adsorption rate is always higher than the diffusion rate. And this is the governing step of dyeing. In case of dyeing with disperse dye, temperature plays an important role. For the swelling of fiber, temperature above 100° C. is required if high temperature dyeing method is applied. Again in case of carrier dyeing method, this swelling occurs at 85-90° C. For disperse dyeing the dye bath should be acidic and pH should be in between 4.5-5.5. For maintaining this pH, generally acetic acid is used At this pH dye exhaustion is satisfactory. During color development, correct pH should be maintained otherwise fastness will be inferior and color will be unstable.

Carrier Dyeing Method

Figure 5:
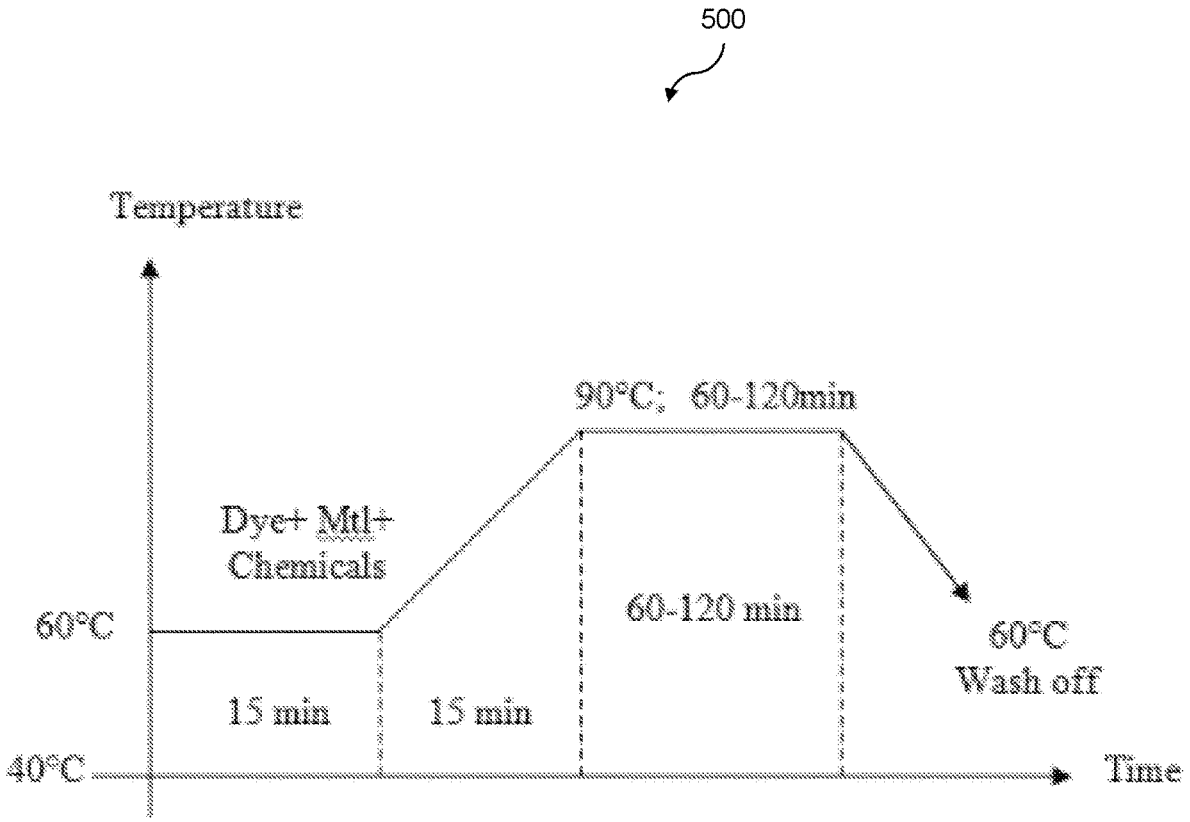
FIG. 5 illustrates example steps in a method for dyeing a yarn or terry fabric in accordance with one or more example embodiments.

FIG. 5 illustrates example steps in a method 500 for dyeing a yarn or towel in accordance with one or more example embodiments. At first, a paste of dye and dispersing agent is prepared and then water is added to it. Dye bath is kept at 60° C. temperature and all the chemicals along with the material are added to it. Then the bath is kept for 15 min without raising the temperature. pH of bath is controlled by acetic acid at 4-5.5. Now temperature of dye bath is raised to 90° C. and at that temperature the bath is kept for 60 min. Then temperature is lowered to 60° C. and resist and reduction cleaning is done if required. Reduction cleaning is done only to improve the wash fastness. Material is again rinsed well after reduction cleaning and then dried.

High Temperature Dyeing Method

Figure 6:
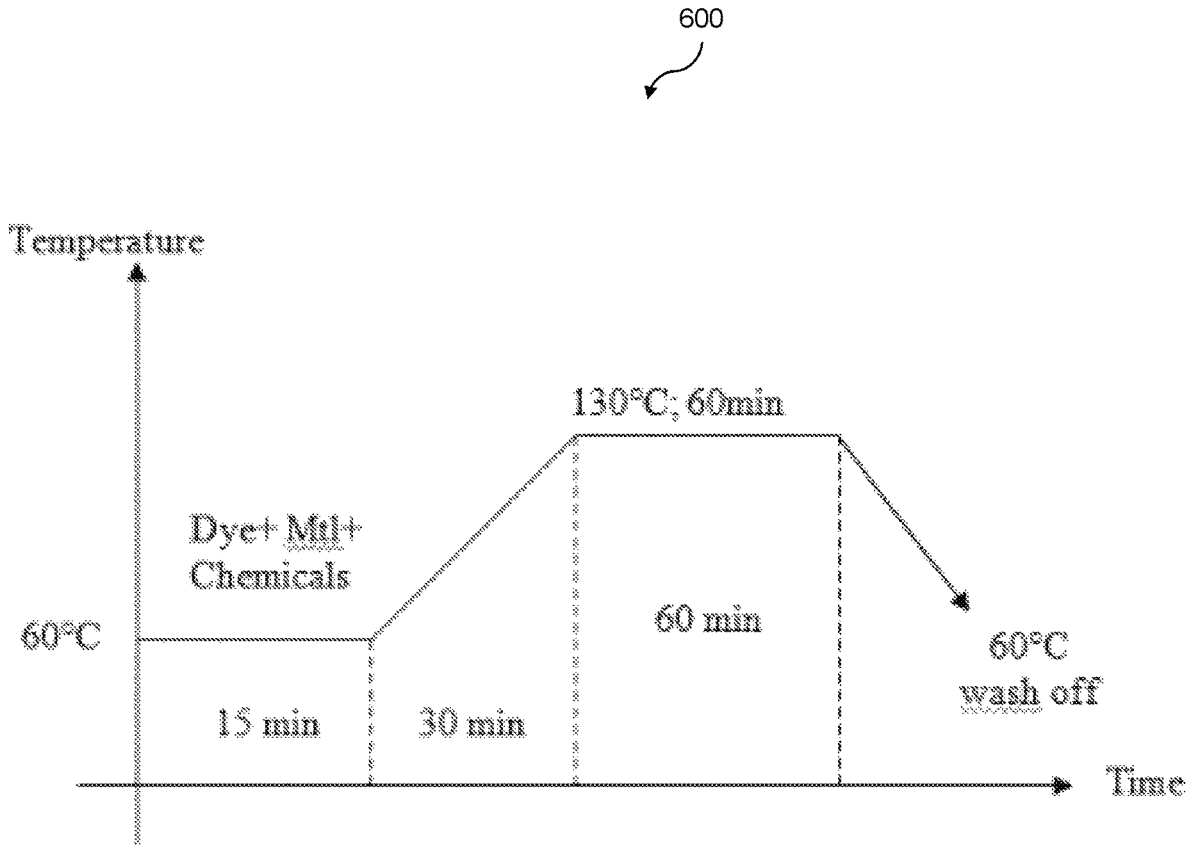
FIG. 6 illustrates example steps in a method for dyeing a yarn or terry fabric in accordance with one or more example embodiments.

FIG. 6 illustrates example steps in another method 600 for dyeing a yarn or towel in accordance with one or more example embodiments. At first a paste of dye and dispersing agent is prepared and water is added to it. pH is controlled by adding acetic acid. This condition is kept for 15 minutes at temperature 60° C. Then the dye bath temperature is raised to 130° C. and this temperature is maintained for 1 hour. Within this time, dye is diffused in dye bath, adsorbed by the fiber and thus required shade is obtained. The dye bath is cooled as early as possible after dyeing at 60° C. The towel is hot rinsed and reduction cleaning is done if required. Then the towel is finally rinsed and dried.

The terry product 100 may be disperse dyed or bleached. The weight of the terry product 100 can be about 300-1000 gram per square meter (GSM). The pile yarns 130, 150 may be looped or sheared. High dyeing temperatures, typically 120-130° C., swell the fiber and allow the dye to penetrate. At the end of the dyeing, when fiber contracts to its original crystalline orientation, the dye becomes trapped within the fiber. Dye on the surface of the fiber is loosely held. This unfixed dye, especially in two-fiber dyeing (e.g., wool-polyester and cotton-polyester terry fabrics) is removed by reduction clearing followed by rinsing.

Some advantages include the towel may be woven using undyed polyester, and then made up or woven into a towel, which may be dyed in disperse dye. This process colors polyester fibers only and disperse dye has affinity for polyester but not cotton. The advantage of this technique is lower color minimums as well as the ability to make to order. This is very important when servicing boutique hotels that have custom requirements. Such a towel can be washed with chlorine or any kind of bleach with no or insignificant change in color. This makes laundering convenient especially for hotels/hospitality industry because no segregation of white and colored goods is needed. Also, bleaching helps with sanitization of towels.

Following weaving step 306, 404, the terry product or pile fabric, terms which are used interchangeably herein, may be subjected to a post-formation processing. In one example, the treatment step can include a thermal treatment in one or more of a dyeing and finishing phase, a drying phase, or in a separate process phase. The thermal treatment is described next and its application to the dyeing and finishing phase, the drying phase, and as separate process phase is described afterwards.

In accordance one embodiment, the treatment step includes exposing the pile fabric to thermal energy for a period of time that is sufficient to cause the polymeric yarns to shrink. Such treatment step may include exposing the pile fabric to heated air, a heated surface (e.g. a calendar roll), heated water (e.g. heated liquid bath or heated steam), or an infrared heat source. In such an embodiment, the treatment step includes advancing the pile fabric through a machine that exposes the pile fabric to thermal energy for a period of time that is sufficient to induce shrinkage in the non-heat set yarns. The thermal energy is sufficient to expose the pile fabric to a temperature that is greater than or equal to the glass transition temperature (Tg) of the polymeric yarn. For instance, the surface temperature of the pile fabric during the thermal treatment step may approach or exceed the glass transition temperature (Tg) of the polymeric yarns. For non-heatset PET filament yarns, the glass transition temperature (Tg) is between about 67 to 81 degrees Celsius. For non-heatset PLA filaments, the glass transition temperature (Tg) is between about 60 to 65 degrees Celsius. For non-heatset PP filaments, the pile fabrics are exposed to temperature between about 100 and to 130 degrees Celsius. Accordingly, the desired surface temperature of the pile fabric should fall within or exceed somewhat the stated ranges for each of the fibers mention above.

The dyeing and finishing phases include may include de-sizing step, a bleaching step, a dyeing step, and/or washing step. In one example, the bleaching phase may include the thermal treatment that is sufficient to cause shrinkage of the polymeric yarns in the piles as described above. For instance, washing may include exposing the terry fabrics to elevated temperatures that are needed to bleach the terry fabric but could also induce shrinkage in the polymeric yarns. In another example, the dyeing phase may include a thermal treatment that is sufficient to cause shrinkage of the polymeric yarns in the piles, as described above. For instance, the dying phase may include applying reactive dyes to natural fiber yarns, and cotton yarns in particular, at elevated temperatures sufficient to cause yarn shrinkage. Either batch, semi-continuous, or continuous dyeing system can be used to apply reactive dyes the pile fabric. Other dyes can be used depending on the particular fiber blend. In still another example, for example for package dyed yarns, the washing step can include a thermal treatment that is sufficient to cause shrinkage of the polymeric yarns in the piles. The dyeing and finishing phase could also include printing as needed.

The finishing phase of step is when various functional finishes or agents are added to the pile fabric to improve or augment performance characteristics of the terry article. In one example, the pile fabric can be treated with a hydrophilic agent, such as silicones. In another example, the finishing step includes application of one or more softeners to the pile fabric, such as cationic softeners, non-ionic softeners, and silicones. In another example, the finishing step includes application of an antimicrobial agent to the pile fabric. In accordance with one embodiment, the finishing step could also include the thermal treatment that causes shrinkage of the polymeric yarns in the piles.

In accordance with one embodiment, after dyeing and finishing phases of step, the drying step is used to remove moisture from the pile fabric. The drying step also includes a thermal treatment step that can cause shrinkage of the polymeric yarns that may cause the piles to shrink. For example, when the pile fabrics include non-heat set yarns in pile components, a treatment step that dries the pile fabric may also cause the polymeric yarns to shrink, as explained above.

It should be appreciated that in some case, dyes and functional finishes can be applied to the pile fabric in any particular order. For example, the functional agents can be applied along with the application of the dyes, before application of the dyes, or after application on the dyes. It should be appreciated that dyeing, finishing, and drying phases of step may be in-line and considering a continuous process step.

In accordance with another embodiment, the pile fabric can be dried and then a subsequent process phase is used where the thermal treatment step is applied the pile fabric to cause the polymeric yarns to shrink. For example the pile fabric can be exposed to the desired thermal energy levels for a period of time that is sufficient to induce shrinkage. The exposure time is dependent on the dwell time of pile fabric within a heating machine, which is related to the machine speed and length of the heating zones within the heating machine. In one example, the pile fabric is advanced through the heating machine at a rate that ranges between 2.0 meters/min up to about 30 meters/min, which varies based on number heating zones. In case of batch processing, the pile fabric may be process for periods sufficient to induce shrinkage.

As noted above, the it should be appreciated that the thermal treatment step can be part of one or more of the different steps that comprise the dyeing and finishing phase, the drying phase, or in a separate thermal step. Accordingly, the thermal treatments include hot water (as part of dyeing finishing phases discussed above), convection, heated steam, infrared, hot air, surface rolls, hot oil can, through-air ovens and the like. In accordance with the alternative embodiments, the treatment step can be a process step other than thermal treatment. For instance, a chemical treatments may be used induce yarn shrinkage. In other embodiments, plasma treatments or other types of treatment can be used to induce yarn shrinkage.

Following the post-formation processing step, the method includes a cutting step where the pile fabric is cut to size of one or more terry articles, such as bath towel, a hand towel, and a washcloth. Following cutting, additional edge binding or hems can be applied to finish the cut edges. After the cutting step, a packing step places the finished terry articles in suitable packaging for shipment.

Some features of the above described example embodiments include increasing longevity of the terry towels, improving quality and comfort of the terry towels or products, and reducing operating expense for maintaining the terry towels or products by significantly reducing drying time and energy usage. Reduction in drying time may be a result of, for example, improved wickability and capillary rise in the polyester part of the plied yarns.

One example embodiment provides terry towels or products having certain physical and aesthetic characteristics which are more luxurious than and superior to the characteristics of the convetion terry towels which are presently known. Another example embodiment can provide terry towels or products which more effectively utilize the beneficial properties of the plied yarns as compared to conventional terry towels or products so as to provide quick dry properties. This property may be specifically important in the hospitality industry as it may result in reduced drying time and reduced energy usage. Another example embodiment provides terry towels or products with high temperature resistance and better dimensional stability because of 100% cotton coverage on the surface of the terry fabric, which provides insulation to heat. Another example embodiment is a terry towel or product including a plurality of plied yarns. The terry towel may be woven or knitted. If the terry towel is knitted, then it may be warp or weft knitted.

Another example embodiment provides terry towels or products with 100% cotton coverage on the surface of the towel such that all the fibers that comes in contact with skin are cotton, giving the terry towels or products a great feel and comfort. These and other embodiments can be accomplished by providing a unique terry towel or product construction in which the plied yarns are located in the pile, and 100% cotton yarns are located at the ground of the towel for improved hand with the cotton of the plied yarns being on the outside surface and improved physical characteristics with the polyester fibers being located in the yarns to give strength and durability to the terry fabric.

While there have been shown, described and pointed out, fundamental novel features of the disclosure as applied to the example embodiments, it will be understood that various omissions and substitutions and changes in the form and details of examples illustrated, and in their operation, may be made by those skilled in the art without departing from the spirit of the disclosure. Moreover, it is expressly intended that all combinations of those elements and/or method operations, which perform substantially the same function in substantially the same way to achieve the same results, are within the scope of the disclosure. Moreover, it should be recognized that structures and/or elements and/or method operations shown and/or described in connection with any disclosed form or embodiment of the disclosure may be incorporated in any other disclosed or described or suggested form or embodiment as a general matter of design choice. It is the intention, therefore, to be limited only as indicated by the scope of the claims.

What is claimed is:

1. A terry product, comprising:

a ground component including a plurality of ground warp yarns and a plurality of ground weft yarns interwoven with the plurality of ground warp yarns, the ground component including a lower side and an upper side opposed to the lower side along a vertical direction, wherein the ground warp yarns and the ground weft yarns consist of cotton yarns; and a pile component including a plurality of piles that extend away from the ground component along the vertical direction, the plurality of piles formed from a set of pile yarns comprising plied yarns, wherein the plied yarns consist of cotton yarns and polyester yarns, wherein the polyester yarns in the plied yarns have a count in a range of about 30 denier to about 885 denier, and wherein the cotton yarns in the plied yarns have a count in a range of about 5 Ne to about 100 Ne, wherein the polyester yarns in the set of pile yarns are dyed using a highly exhaust (H-E) reactive dye mixed with a disperse dyed prior to weaving the terry product.

2. The terry product of claim 1, wherein the plied yarns comprise at least one of two-ply yarns, three-ply yarns, four-ply yarns, five-ply yarns and six-ply yarns.

3. The terry product of claim 1, wherein the cotton yarn is white or undyed.

4. The terry product of claim 1, wherein the polyester yarn comprises at least one of spun yarn and continuous filament yarn.

5. The terry product of claim 1, wherein the polyester yarn is a dope-dyed yarn, a fiber-dyed yarn, or a yarn-dyed yarn.

6. The terry product of claim 1, wherein the terry product is disperse dyed or bleached.

7. The terry product of claim 1, wherein the weight of the terry product is about 300-1000 gram per square meter (GSM).

8. The terry product of claim 1, wherein the pile yarns are looped or sheared.

9. The terry product of claim 1, wherein the ground warp yarns comprise plied yarns.

10. The terry product of claim 1, wherein the ground weft yarns comprise plied yarns.

11. A method of making a terry product comprising:

dyeing a polyester yarn in a dye bath comprising a highly exhaust (H-E) reactive dye and a disperse dye at an elevated temperature of about 130 degrees C., wherein the dye bath has a pH between 4.5 and 5.5;

plying the dyed polyester yarn with cotton yarn to form a plied yarn;

weaving a plurality of ground warp yarns with a plurality of ground weft yarns; and weaving the plied yarn in a pile direction to form a plurality of piles such that the ground warp yarns and the ground weft yarns consist of cotton yarns, and the plied yarns in the pile direction consist of cotton yarns and polyester yarns, wherein the polyester yarns in the plied yarns have a count in a range of about 30 denier to about 885 denier, and wherein the cotton yarns in the plied yarns have a count in a range of about 5 Ne to about 100 Ne.

* * * * *